US011608656B2

(12) United States Patent
Jordan

(10) Patent No.: US 11,608,656 B2
(45) Date of Patent: Mar. 21, 2023

(54) PORTABLE REMOVABLE BARRIER

(71) Applicant: Joshua Peter Harold Jordan, Brooklyn, NY (US)

(72) Inventor: Joshua Peter Harold Jordan, Brooklyn, NY (US)

( * ) Notice: Subject to any disclaimer, the term of this patent is extended or adjusted under 35 U.S.C. 154(b) by 220 days.

(21) Appl. No.: 17/249,018

(22) Filed: Feb. 17, 2021

(65) Prior Publication Data

US 2022/0259889 A1 Aug. 18, 2022

(51) Int. Cl.
*E04H 17/26* (2006.01)
*E01F 13/02* (2006.01)

(52) U.S. Cl.
CPC ..... *E04H 17/266* (2013.01); *E01F 13/028* (2013.01)

(58) Field of Classification Search
CPC ..... E04H 17/26; E04H 17/266; E04H 17/18; E01F 13/02; E01F 13/022; E01F 13/028
See application file for complete search history.

(56) References Cited

U.S. PATENT DOCUMENTS 3,622,980 A 11/1971 Elledge, Jr.
4,605,204 A 8/1986 Schmanski et al.
4,813,584 A 3/1989 Wiley
5,570,826 A 11/1996 Garbes et al.
5,685,668 A 11/1997 Justice
6,012,504 A * 1/2000 Siegal ..... E04B 2/7416 160/24
6,082,926 A 7/2000 Zimmer
6,142,701 A 11/2000 Falcon
6,733,204 B1 5/2004 Paniccia
6,776,398 B1 * 8/2004 Tsai ..... E01F 13/028 256/45
7,056,069 B1 6/2006 Warnke
7,083,357 B2 8/2006 Lamore
7,217,061 B2 * 5/2007 Stratton ..... E01F 13/028 160/250
7,237,792 B2 7/2007 Mrofka et al.
7,341,397 B2 3/2008 Murphy
7,354,218 B1 4/2008 Dyke et al.
7,377,490 B1 5/2008 Khosravian
(Continued)

FOREIGN PATENT DOCUMENTS

CH 389004 A * 3/1965
WO WO-2004016858 A1 * 2/2004 ..... E01F 13/028

*Primary Examiner* — Jonathan P Masinick
(74) *Attorney, Agent, or Firm* — Dunlap Bennett & Ludwig, PLLC

(57) ABSTRACT

A barrier apparatus provides a portable perimeter barrier between people, animals, property or equipment and incoming potential hazards. The apparatus functions as a security or safety device which may be operated by one person in multiple conditions, and may be hand operable or motor-driven. The apparatus is capable of providing alternative electric power distribution and lighting. The apparatus comprises a housing, retractable barrier material, and a mechanical system. The apparatus may include lights, an alarm, and a motion detector. The apparatus may be used with or without a vehicle, and may be carried by a vehicle tow hitch. The apparatus is easily operable by extending the rolls of barrier material from the housing. The apparatus may provide a barrier covering a distance of up to about 170 feet across a road or any area to quickly block or direct the flow of traffic or to establish a perimeter.

16 Claims, 4 Drawing Sheets

(56) References Cited

U.S. PATENT DOCUMENTS

| | | | | |
|---|---|---|---|---|
| 7,438,112 | B2 | 10/2008 | Cheng | |
| 7,950,870 | B1 | 5/2011 | Thompson et al. | |
| 8,087,443 | B2 | 1/2012 | Snyder et al. | |
| 8,490,668 | B2 | 7/2013 | Snyder et al. | |
| 8,707,595 | B2 * | 4/2014 | Beemsterboer | B65H 75/425 40/515 |
| 8,864,408 | B1 | 10/2014 | Dyke | |
| 8,991,470 | B1 | 3/2015 | Pacheco | |
| 9,522,629 | B2 | 12/2016 | Schloesser | |
| 9,714,491 | B2 * | 7/2017 | Wettern | E01F 13/022 |
| 10,053,888 | B2 | 8/2018 | Mitchell | |
| 10,100,574 | B2 | 10/2018 | Reiner et al. | |
| D851,353 | S * | 6/2019 | Miller | D34/27 |
| 10,513,870 | B1 | 12/2019 | Jackson | |
| 10,947,682 | B2 * | 3/2021 | Foster | E01F 9/646 |
| 11,008,774 | B2 * | 5/2021 | Shi | E04H 17/124 |
| 2002/0063248 | A1 * | 5/2002 | Siegler | E01F 13/028 256/37 |
| 2003/0016996 | A1 | 1/2003 | Gelfand et al. | |
| 2003/0080236 | A1 * | 5/2003 | Armstrong | B65H 16/005 242/588 |
| 2003/0164485 | A1 | 9/2003 | Olson et al. | |
| 2005/0098770 | A1 | 5/2005 | Schell | |
| 2005/0168818 | A1 * | 8/2005 | Hudson, Jr. | B65H 75/446 359/515 |
| 2005/0229454 | A1 | 10/2005 | Haggard | |
| 2006/0140717 | A1 | 6/2006 | Lamore | |
| 2007/0176158 | A1 | 8/2007 | Robinson | |
| 2007/0289547 | A1 | 12/2007 | Haugh et al. | |
| 2009/0166998 | A1 | 7/2009 | Groeneweg | |
| 2009/0200415 | A1 | 8/2009 | Pessach et al. | |
| 2010/0101156 | A1 | 4/2010 | Holroyd | |
| 2012/0018691 | A1 | 1/2012 | Roth | |
| 2012/0256149 | A1 | 10/2012 | Sylvester | |
| 2014/0054404 | A1 * | 2/2014 | Mitchell | B65H 75/38 242/370 |
| 2014/0231734 | A1 | 8/2014 | Bishop | |
| 2016/0215462 | A1 * | 7/2016 | Marchetti | E01F 7/00 |
| 2016/0264043 | A1 | 9/2016 | Schloesser | |
| 2018/0044868 | A1 | 2/2018 | Miller | |
| 2020/0302833 | A1 * | 9/2020 | Kay | G09F 9/301 |

* cited by examiner

PORTABLE REMOVABLE BARRIER

BACKGROUND OF THE INVENTION

The present invention relates to construction barriers, and more particularly to a portable barrier which provides a removable perimeter barrier between people, animals, property or equipment and incoming potential hazards.

Though construction barriers exist, there remains a need for a compact portable barrier, capable of being easily installed, and transportable both by users on foot and by vehicles.

SUMMARY OF THE INVENTION

The present invention provides an unprecedented portable barrier apparatus and method for its use.

In one aspect, the present invention may comprise a barrier apparatus which provides a portable perimeter barrier between people, animals, property or equipment and incoming potential hazards. The barrier apparatus functions as a security or safety device which may be operated by one person in multiple conditions. The barrier apparatus comprises a central support frame or housing, and first and second rolls of barrier material removably retained thereby. The barrier apparatus is easily operable by wheeling out and extending the rolls of barrier material from the central support, the first roll to the right, the second roll to the left, or both rolls to fully extend the barrier material. When extended and unfurled, the removable barrier apparatus may extend to cover a distance of up to about 170 feet across a road or an area to quickly block or direct the flow of traffic or to establish a perimeter.

In one aspect a barrier apparatus comprises a central housing, first and second retractable barrier panels, and a mechanical system. The barrier apparatus may include lights, an alarm, a motion detector and a mechanical system. The apparatus may be used with or without a vehicle, and may be carried by a vehicle tow hitch. The apparatus may be operated by hand or by a motor. The apparatus may be powered by a 12V battery, solar panel, or a vehicle.

In a further aspect, the barrier apparatus may provide alternative electric power distribution and lighting.

In another aspect, the barrier apparatus provides a compact portable barrier, capable of being easily installed, easily removed, and easily transported both by users on foot and by vehicles.

These and other features, aspects and advantages of the present invention will become better understood with reference to the following drawings, description and claims.

BRIEF DESCRIPTION OF THE DRAWINGS

The preferred embodiment of the claimed subject matter will hereinafter be described in conjunction with the appended drawings provided to illustrate and not to limit the scope of the claimed subject matter, where like designations denote like elements, and in which:

It is to be understood that like reference numerals refer to like parts throughout the several views of the drawings.

DETAILED DESCRIPTION OF THE INVENTION

Figure 1:
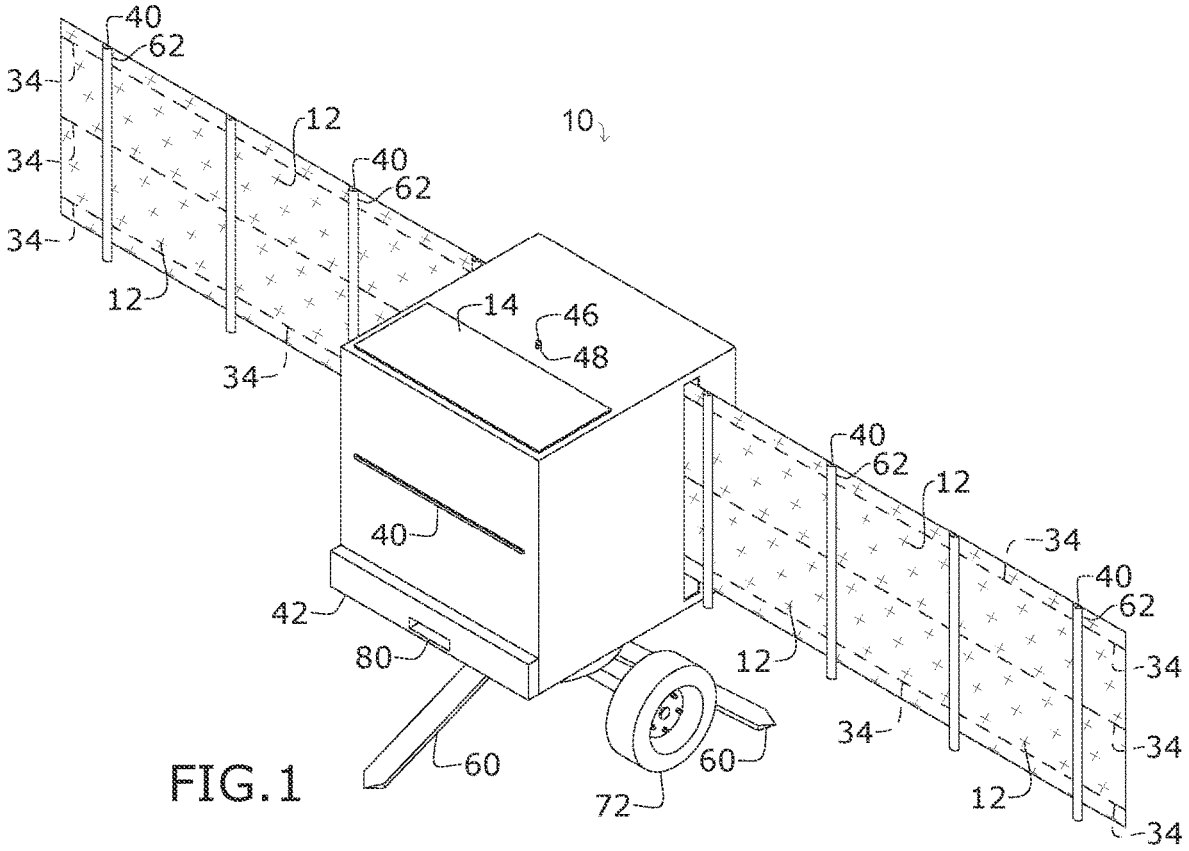
FIG. 1 is a perspective view of an exemplary embodiment of the present invention, shown in use.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

As used herein, "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, as there is no intention to be bound by any express or implied theory presented in the preceding technical field, background, brief summary or the following detailed description, it is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Broadly, one embodiment of the present invention provides a portable barrier apparatus and method for its use. The removable barrier may be used to create a perimeter barrier between people, animals, property or equipment and incoming potential hazards. The removable barrier may function as a security or safety device and may be operated by one person in multiple conditions. The removable barrier may provide alternative electric power distribution and lighting.

In an exemplary embodiment, the barrier apparatus of the present invention may include a barrier stand, a base, a lock pin, a support frame, a housing, a first roller pole, a first roll of mesh barrier material on a wheel, a first pulley and wheel all-in-one, a second roller pole, a second roll of mesh barrier material on a wheel, a second pulley and wheel all-in-one, at least one supporting cable, a plurality of cable loops, at least one cable hook and a lowering handle. In some embodiments the barrier apparatus may include a front impact cushion. In some embodiments, the barrier apparatus may include a tow hitch receiver insert In some embodiments the barrier apparatus may further include a solar panel, an electric motor bracket. In some embodiments the barrier apparatus may include an LED light, and an LED light messenger.

Referring now to the FIGS. 1 through 10, in an exemplary embodiment of the present invention, a removable barrier apparatus 10 may comprise one or more of the following components or elements and combinations thereof.

a roller pole 11
at least one sheet of mesh barrier material 12
at least one solar panel 14
a frame support or housing 16
a shaping wheel 18
an electric motor 20
a handle 22
a retractable tow hitch receiver insert 24
a barrier stand 26
a barrier stand base 28
a lock pin 30
a main frame housing 32
a supporting cable 34
a hook and ring 36
a gear 38
at least one LED light strip 40
an impact cushion 42
an LED light message display 44
a threaded rod 46
a threaded rod nut 48
a bearing 50
an electric motor pulley 52
at least one plastic fastener 54
a square spring 56
at least one base leg 60
a mesh loop 62
a pinhole 64
at least one mesh placeholder 66
a bearing housing 68
a ring 70
base wheels 72
a handle shaft 74
receiver pins 76
rivets 78
a handle slot 80

The components or elements of the barrier apparatus may be made of any suitable material by any suitable process. In some embodiments, portions of the barrier apparatus may be made of aluminum, a light metal, or the like.

Figure 2:
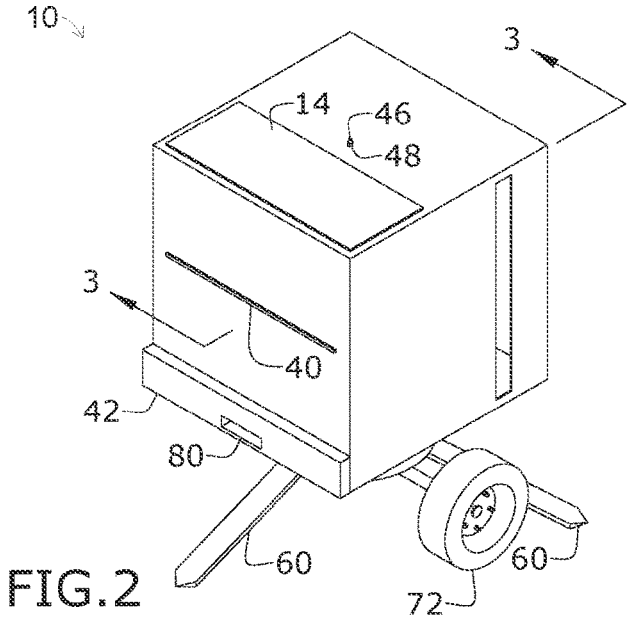
FIG. 2 is a perspective view of an exemplary embodiment of the present invention.
Figure 3:
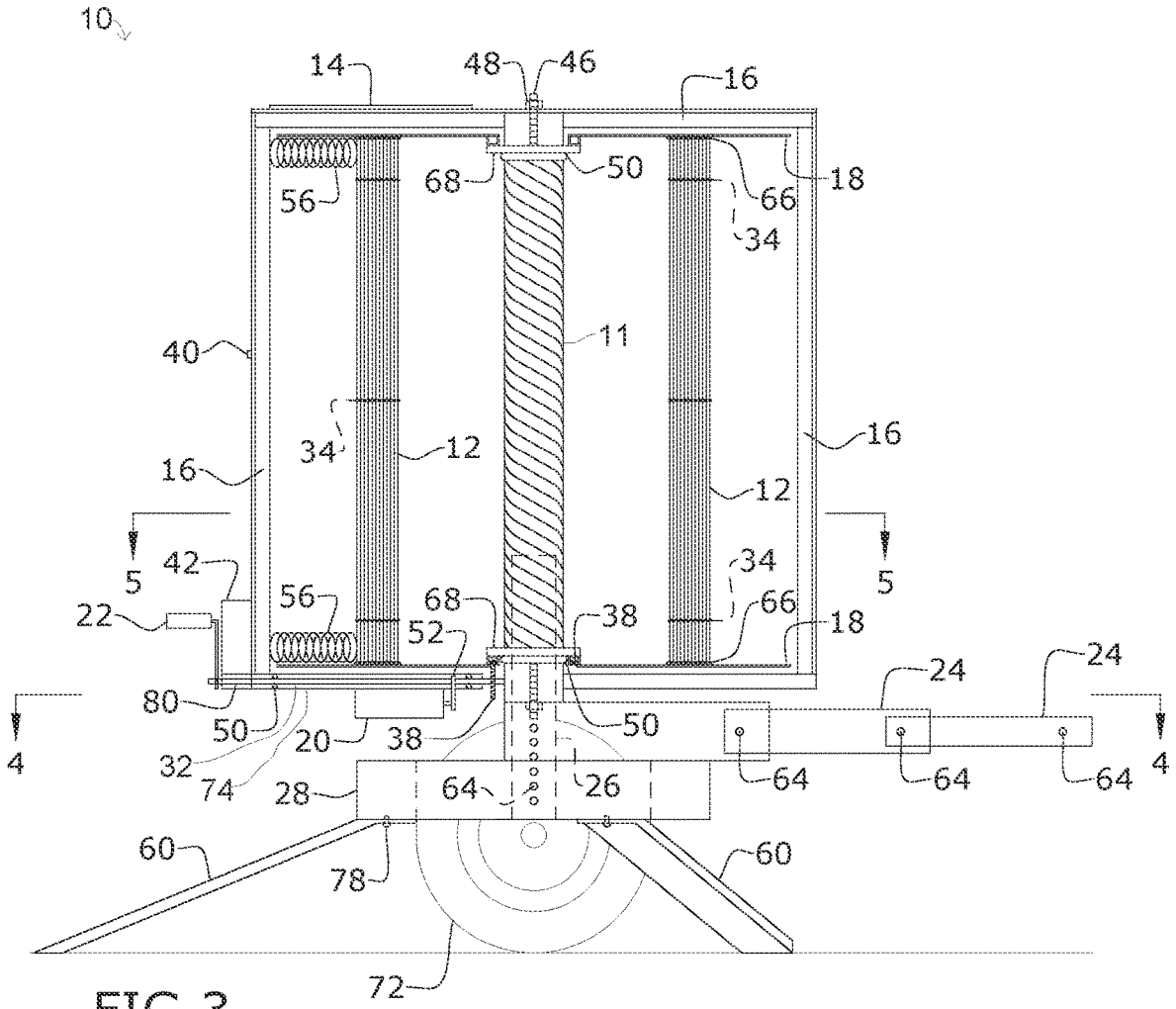
FIG. 3 is a section view taken along line 3-3 of FIG. 2, showing further detail.

FIGS. 1 and 2 are perspective views of a portable barrier apparatus, shown generally at 10, FIG. 1 showing the apparatus in use with the mesh barrier material fully extended. FIG. 2 is a view of the apparatus with the mesh barrier material stored. FIG. 3 is a section view taken along line 3-3 of FIG. 2, showing further detail. The barrier apparatus 10 may have a top portion, a bottom portion, a front portion, a rear portion, a right side portion, and a left side portion.

The barrier apparatus comprises a frame support 16 or housing which comprises an exterior surface, a top panel, a bottom panel, and at least one side panel, and an interior portion defined by the top panel, bottom panel, and at least one side panel. In some embodiments the at least one side panel may comprise a front panel, a back panel, a right side panel, and a left side panel. The housing may be of any suitable shape, such as, for example without limitation, cylindrical, rectangular, cubic, or the like. In one embodiment, the housing 16 may be in the shape of a cube. In some embodiments, the housing bottom panel may comprise a 2 feet square panel housing base panel.

Figure 4:
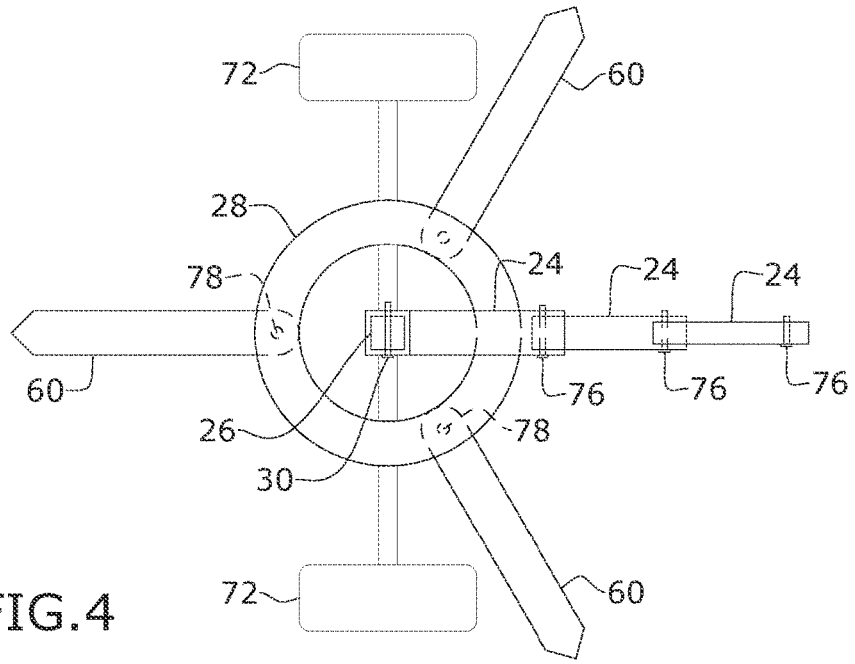
FIG. 4 is a section view taken along line 4-4 of FIG. 3, showing further detail.

FIG. 4 is a section view taken along line 4-4 of FIG. 3, showing further detail of the bottom or lower portion of the apparatus. The apparatus may further comprise a barrier stand 26, a barrier stand base 28 and barrier wheels 72. As seen at FIG. 4, the housing 16 may be supported by the barrier stand 26, a vertical barrier support stand 26 operably connected to the barrier stand base 28. In some embodiments, the housing 16 may be adjustable as to height by adjustment of the support stand 26 held with a lock pin 30. The apparatus further comprises barrier wheels 72.

Referring again to FIG. 3, in an exemplary embodiment, the housing includes a bottom panel may include a central opening which accommodates a bearing 50 and a threaded rod 46 which extends upwardly through the housing 16. The barrier stand 26 may extend through the central opening. The barrier stand may comprise a square tube. The top portion of the barrier stand extends upwardly into the roller pole 11. The threaded rod 46 passes through the bottom panel and extends upwardly through the roller pole 11. The threaded rod 46 is bolted onto the frame support top panel of the housing 16 and secured in place by a threaded rod nut 48. The housing frame may comprise a 2 inch by 4 inch support which extends above the mesh barrier material 12. The housing 16 extends at a 90 degree turn and the solar panel 14, square spring 56 and the impact cushion 42 are fastened to it. The impact cushion 42 has a handle slot 80 to hide the handle when not in use. The floor or bottom panel of the housing supports a shaping wheel 18 fastened to the housing. The shaping wheel 18 is constructed and arranged to move the mesh barrier material as the shaping wheel rotates on the roller pole 11. The roller pole 11 is fitted with bearings 68 fastened to the shaping wheel 18. The housing 16 is fastened to the frame support 26. The mesh material 12 sits in the shaping wheel 18 and is guided by the mesh place holders 66. The square spring 56 pushes against the plastic fittings 54 to keep the mesh material 12 in place. The supporting cable 34 runs through the length of the mesh material 12 and has rings 70 and hooks 36. The housing 16 houses the handle 22, the bearings 68, that are fastened to the handle shaft 74, also the gear 38 that turns the shaping wheel.

In some embodiments an electric motor 20 is bolted to the main frame housing 32, and is operably connected to an electric motor pulley 52 when equipped. The rotating motion will turn the handle 22 and the shaping wheel 18 at the same time.

The base 28 may be any suitable shape and dimensions. In an exemplary embodiment the base 28 may be a circular base 28 or skirt, and may be provided as a unitary piece. At least one support leg 60 is provided. Base 28 may be supported by at least one support leg 60 to provide additional balance and support. In some embodiments a plurality of support legs may be provided. In some embodiments three support legs 60 are provided, which may be riveted to the circular base 28 by rivets 78. The support legs may be enfolded.

As seen at FIGS. 1-5, right and left wheels 72 may be provided for transportation and portability.

Also seen at FIG. 4, the barrier apparatus 10 may include a retractable extensible tow hitch receiver insert 24. Tow hitch receiver insert 24 may be segmented and constructed and arranged to telescope as retained by receiver pins 76 to provide a length of up to about three feet. The receiver insert may have dimensions of 4 inch by 4 inch square body with pin holes extending up into the retractable tow hitch insert. In some embodiments, the insert comprises three retractable sections that can go into a vehicle tow hitch receiver.

Figure 5:
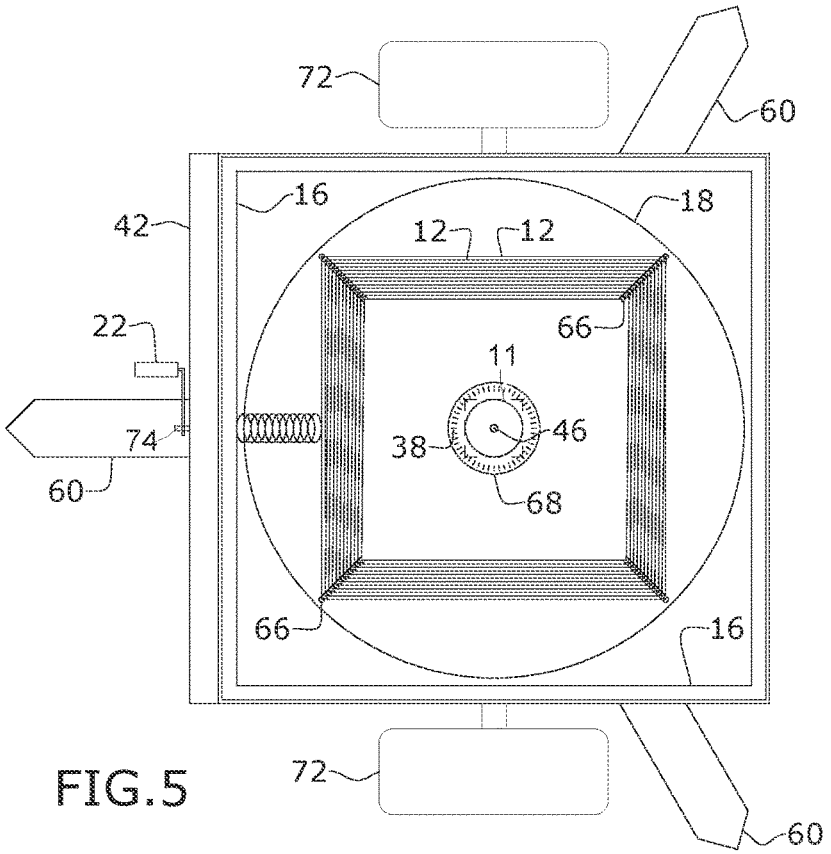
FIG. 5 is a section view taken along line 5-5 of FIG. 3, showing further detail.

FIG. 5 is a section view taken along line 5-5 of FIG. 3, showing further detail of the interior of housing 16.

Figure 7:
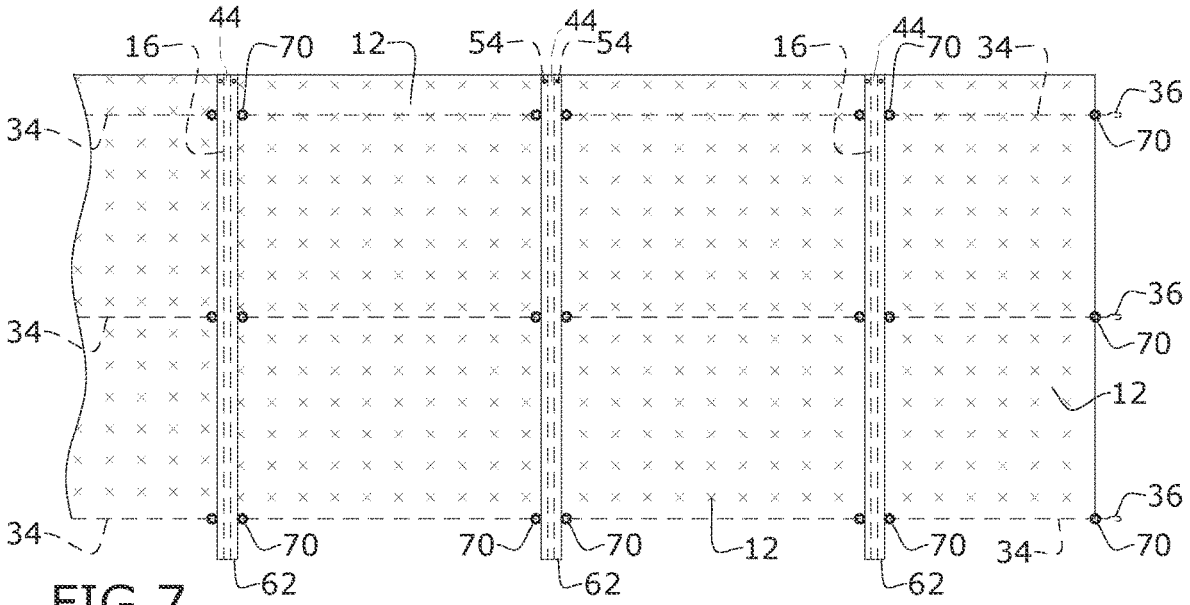
FIG. 7 is a front view of the mesh barrier in accordance with an exemplary embodiment of the present invention.
Figure 8:
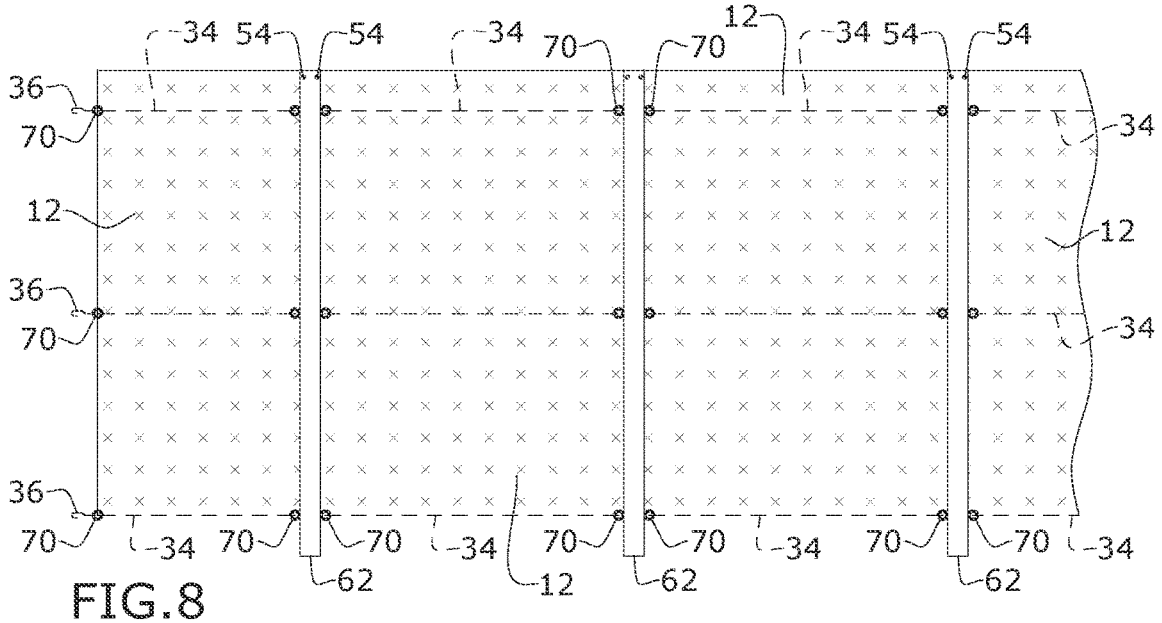
FIG. 8 is a back view of the mesh barrier in accordance with an exemplary embodiment of the present invention.

The barrier apparatus comprises mesh barrier material 12, shown laterally extended in FIGS. 1, 7 and 8, and fully unrolled or unfurled in FIG. 1 while the barrier is in use.

Figure 6:
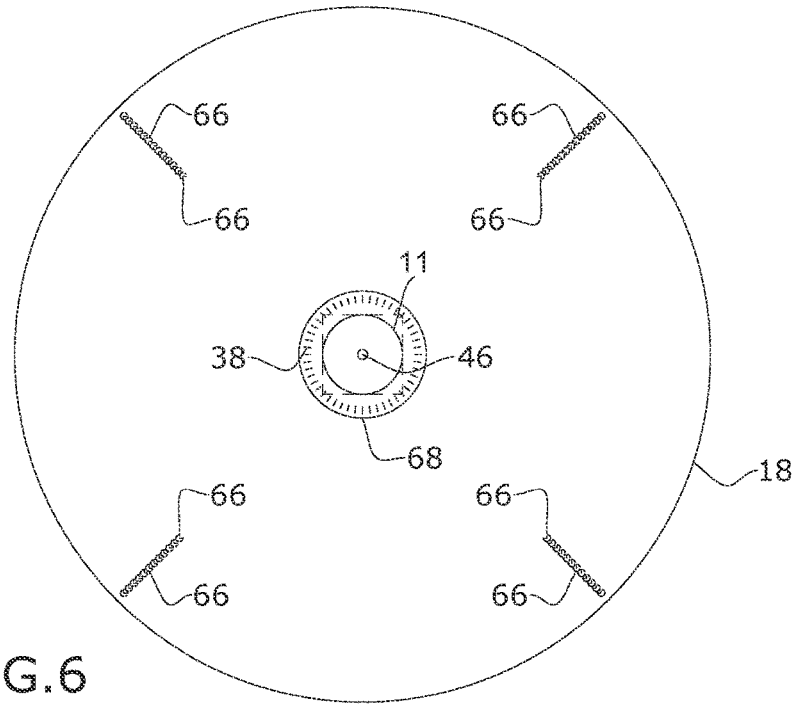
FIG. 6 is a top view of an exemplary embodiment of the present invention showing the mesh wheel.

The mesh barrier element 12 is constructed and arranged to be stored in at least one roll within the frame support or housing 16 while not in use. FIG. 6 is a top view of an exemplary embodiment of the present invention showing the mesh wheel on which the mesh barrier element is stored. The mesh barrier element may be extensible, and may provide a right side barrier portion and a left side barrier portion capable of being rolled out from the frame support 16 for use and retracted for storage between uses. The mesh barrier element 12 may be made of any suitable material.

In an exemplary embodiment of the removable barrier apparatus, the right side barrier portion and left side barrier portion may each comprise a roll of light duty aluminum wire mesh sheeting with square openings. In one embodiment the dimensions of the roll may be three feet in height, and may have any suitable length. Each barrier portion may have a top portion and a bottom portion. In use, each barrier portion may stand 3 feet in height. When in use, the barrier portions may be a distance 1.5-3 feet from the ground or other surface on which the barrier apparatus is removably installed. In use, the mesh barrier portions 12 may be laterally extended from the housing 16 to form a barrier of any suitable length, for example, extending up to about 165-170 feet. In some embodiments, the barrier may comprise a right side barrier portion of about 55 feet in length and a left side barrier portion of about 55 feet in length, and the total lateral length of the barriers may be about 115 feet.

In an exemplary embodiment of the present invention a removable barrier apparatus may include two three-foot high rolls of light duty aluminum wire mesh with square openings. The removable barrier apparatus may have an overall height of about 4 feet, with an adjustable 1 foot ground clearance. The barrier frame may be about 1.5 feet from the front impact cushion to the rear tow hitch receiver insert to the front impact cushion, front to rear. In embodiments including a central roller pole, the barrier frame may be between about 1.5 to 2 feet from right to left. In embodiments including a right roller pole and a left roller pole, the barrier frame may be 1.5 feet from the right roller pole to the left roller pole.

In some embodiments the barrier apparatus may provide a barrier 2.5 feet wide when the barrier mesh is rolled up for storage therein. When a single side is wheeled out by hand, the barrier apparatus may provide a barrier of about 74.5 feet. When both the right barrier mesh and the left barrier mesh are extended, the barrier may be between about 140-170 feet wide. In some embodiments, the barrier may be about 146.5 feet wide.

In some embodiments, the barrier apparatus may be equipped with one or more electronic devices. The barrier apparatus may further comprise a motion detector with an alarm. In some embodiments, the alarm may comprise a sonic alarm such as a horn, and the alarm may include lights. When motion is detected, the alarm may be actuated. Actuation of the alarm may activate lights a horn or other sonic alarm device.

When in use, messages may be displayed in the mesh. Nonlimiting examples of messages may be construction messages, law enforcement messages or messages providing directions.

In some embodiments, the wheel with mesh may be detached from the barrier apparatus, and may be mounted on a pole for use as a separate single barrier device.

The frame support or housing and its components may be made of any suitable material. In some embodiments, the frame support or housing 16 may comprise 4 inches square tubing with other segments and square panels.

As shown at FIGS. 1-2, a front impact cushion 42 may be located at the front of the housing. The front impact cushion may include a handle slot 80, through which the handle 22 may extend. The handle 22 (best seen at FIGS. 3 and 5) may be operatively connected to the handle shaft 74 (as best seen in FIGS. 3 and 5) and the central roller pole 11 (best seen in FIGS. 3, 5 and 6) for extension and retraction of the mesh barrier portions 12.

When the barrier apparatus 10 is carried at the front or back of a vehicle tow hitch receiver, an operator may easily operate the barrier apparatus by wheeling out the roll of material 12 to the right, left or both sides from the center roller pole 11.

The mesh barrier material 12 may be wheeled out or extended, and retracted in, by hand, by rotation of the handle 22. Alternatively, the barrier apparatus may also include an electric motor 20, and the mesh barrier material may be extended or retracted thereby.

The barrier apparatus may include lights, such as, for example without limitation, LED light strips 40, which may be powered by any suitable means, such as, for example without limitation, a vehicle to which the barrier apparatus is connected, a 12V battery a solar power system, or the like.

As seen at FIGS. 1-3, at least one solar panel 14 may be carried by the housing 16. Though the solar panel 14 may be located anywhere on the housing 16, it is shown at a top panel of the housing 16. In some embodiments, at least one solar panel may be embedded in, or carried by, the mesh barrier material 12.

As seen at FIGS. 1, 2 and 4, at least one LED light strip 40 may be provided. As shown at FIG. 4, an LED light message 44 may be displayed. In some embodiments, reflectors may be provided instead of LED lights. In such an embodiment, the entire system may be constructed and arranged to be operated manually, without a power source.

In use, the barrier apparatus may cover a distance of up to about 164.5 feet or 165 feet, across a road to quickly block or direct the flow of traffic, or to establish a perimeter. It can be seen that the barrier apparatus may be used in any suitable area, both indoors or outdoors, to quickly block or direct traffic flow, establish a barrier or establish a perimeter. In some embodiments the barrier may be about 164.5 feet in lateral length.

In some embodiments, the removable barrier apparatus may be joined to a stable or stationery object or building structure, or may be joined to another barrier. These attachments may be effected using the supporting cables 34 that run throughout the length of the mesh barrier material (as seen at FIGS. 1, 7 and 8). As seen at FIG. 7, the first right side mesh barrier portion 12 may further comprise supporting cables 34 each having a plurality of cable attachment rings 70, and having distal cable hooks 36. As seen at FIG. 8, the second left side mesh barrier portion 12 includes supporting cables 34, each having a plurality of cable attachment rings 70, and having distal cable hooks 36. In an exemplary embodiment, each mesh barrier portion may have an upper portion, an intermediate portion and a lower portion, and may further include an upper cable, an intermediate cable and a lower cable. The distal cable hooks 36 are constructed and arranged for attachment to the cable attachment rings 70 of the mesh barrier material.

Figure 9:
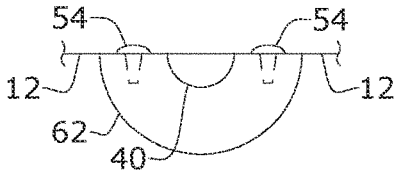
FIG. 9 is a top view of the mesh and mesh loop in accordance with an exemplary embodiment of the present invention.
Figure 10:
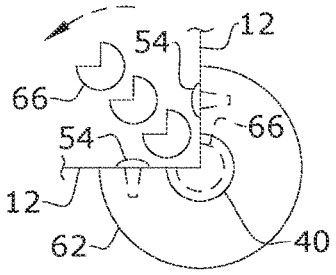
FIG. 10 is a top view of the mesh loop shown with the placeholder, in accordance with an exemplary embodiment of the present invention.

FIG. 9 is a top view of the mesh and mesh loop in accordance with an exemplary embodiment of the present invention. FIG. 10 is a top view of the mesh loop shown with the placeholder, in accordance with an exemplary embodiment of the present invention.

Then the barrier apparatus is being used without a vehicle, a user may push or carry the barrier apparatus to the desired location and operate the barrier apparatus by wheeling out the roll of mesh using the same procedure. The removable barrier has a rating above 370 pounds breaking strength for single side use and above 750 pounds breaking strength for double sided use. The removable barrier may be raised over 4 feet off the ground while deployed to clear obstruction, When the mesh is wheeled out and being used in traffic moving in opposite directions, one side may be turned over so that the lights and the instructions on the mesh may be seen by persons approaching in that direction. This can be accomplished by dislodging and reversing the upper and lower cable from the roller pole. The mesh loops may be increased or decreased in width so that larger signs or instructions may be installed in them. This may be accomplished by removing the fasteners and expanding the loops.

Advantages provided by the removable barrier apparatus are many. The removable barrier apparatus may be quickly deployed by one individual and used to control large crowds or traffic. The apparatus may be easily mounted on a stand. The removable barrier apparatus may be used indoors or outdoors. The apparatus may be used as a guide to direct the flow of traffic, people, or animals. The apparatus may also be used as a security or safety device such as, for example without limitation, home or building security.

The removable barrier apparatus is versatile and may be operated by hand or may be motorized. The apparatus may be used as an alternative source of lighting or electrical power. The apparatus may also be used as an advertising method. Lights provided in the removable barrier apparatus in the system may be powered by a vehicle, a 12 Volt battery, a solar powered or wind powered system. The solar powered system may be embedded in the mesh. The attachment hooks and mesh loops make it possible for the barrier mesh to be joined together to cover a large area.

The reinforced mesh, guided shaping wheel and adjustable loops provide functionality and durability. The mesh may provide a combined breaking strength of 750 pounds.

Advantageously the barrier apparatus may be used indoors or outdoors. The apparatus may be quickly deployed over a 8 lane highway. The apparatus may be motorized and remotely controlled. The three part collapsible hitch section accommodates many vehicles. These features may provide the user the ability of being out of harm's way while operating and monitoring the device under multiple conditions.

The barrier apparatus may be equipped to be an alternative source of electric power distribution and provide lighting when needed.

In some embodiments, the mesh barrier element, when extended, may be reversed to face two different directions at the same time. The mesh loop may be adjustable as to size, or provided in different sizes, providing increased or decreased size to accommodate different size posters.

The mesh has a combined breaking strength of 750 pounds. The removable barrier apparatus may be raised over 4 feet off the ground while deployed to clear any obstruction.

In an exemplary embodiment, the present invention may comprise a method for using a barrier apparatus comprising one or more of the steps described herein, and combinations thereof.

In an exemplary embodiment the present invention provides a removable barrier apparatus comprising at least one sheet of mesh barrier material which may be extended from a first spooled position to a second extended position to provide a temporary barrier.

The removable barrier apparatus further comprises a housing having a top portion, a bottom portion, a front portion, a rear portion, a right side portion and left side portion, the housing defining a barrier support frame, the housing comprising a housing bottom panel with a central opening, and a housing top panel with a central opening, the at least one sheet of mesh barrier material being located in the housing while in its first spooled position, the at least one sheet of mesh barrier material being laterally and reversibly extensible from the first spooled position to the second extended position.

The removable barrier apparatus further comprises a roller pole having an upper portion, a lower portion and an interior lumen; a threaded rod extending upwardly through the bottom panel central opening into the housing, through the interior lumen of the roller pole, and through the top panel central opening, the threaded rod being secured in place on the top panel by a threaded rod nut.

The removable barrier apparatus further comprises a barrier stand having a top portion and a bottom portion, the barrier stand top portion extending upwardly through the bottom panel central opening and into a lower portion of the roller pole interior lumen, the roller pole being mounted for axial rotation with respect to the barrier stand, the at least one sheet of mesh barrier material being carried on the roller pole; and a shaping wheel rotatably mounted on the roller pole, the shaping wheel rotating in response to rotation of a gear operably connected to the roller pole, the shaping wheel being constructed and arranged to move the at least one sheet of mesh barrier material as the shaping wheel rotates on the roller pole.

The removable barrier apparatus further comprises a handle shaft operably connected to the gear; and a rotatable handle operably connected to the handle shaft. In response to rotation of the rotatable handle, the at least one sheet of mesh barrier material may be reversibly extended to the second extended position to provide a temporary barrier.

In some embodiments, the at least one sheet of mesh barrier material comprises a first mesh barrier portion constructed and arranged for reversible lateral deployment from the right side portion of the housing.

In some embodiments, the at least one sheet of mesh barrier material further comprises a second mesh barrier portion constructed for reversible lateral deployment from the left side portion of the housing.

In some embodiments, the removable barrier apparatus further comprises a front impact cushion mounted to the front portion of the housing.

In some embodiments, the removable barrier apparatus further comprises a wheeled base member on which the housing is supported and carried. At least one support leg is mounted to and extends downwardly from the base.

The removable barrier apparatus may further comprise a retractable extensible tow hitch receiver insert located at the rear portion thereof, the tow hitch receiver insert being constructed and arranged for releasable connection to a vehicle tow hitch. The tow hitch receiver insert may comprise a plurality of telescoping portions retained together by at least one receiving pin, the tow hitch receiver insert being up to about three feet in length.

The removable barrier apparatus may further comprise a power source selected from solar power, a 12 Volt battery, an automobile battery and combinations thereof.

The removable barrier apparatus may further comprise a motor. Reversible deployment of the at least one sheet of mesh barrier may be effected remotely.

The removable barrier apparatus of claim may further comprise at least one solar panel. In some embodiments, the at least one solar panel is located at the housing top panel. In other embodiments, the at least one sheet of barrier material further comprises a plurality of solar panels.

The removable barrier apparatus may further comprise at least one reflector. In some embodiments at least one reflector may be located on the at least one sheet of barrier material.

In some embodiments, at least one sign may be removably mounted to the at least one sheet of barrier material.

In some embodiments, the removable barrier apparatus may include at least one LED light.

It should be understood, of course, that the foregoing relates to exemplary embodiments of the invention and that modifications, variations and changes in detail may be made without departing from the spirit and scope of the invention as set forth in the following claims.

What is claimed is:

1. A removable barrier apparatus comprising:

at least one sheet of mesh barrier material which may be extended from a first spooled position to a second extended position to provide a temporary barrier;

a housing having a top portion, a bottom portion, a front portion, a rear portion, a right side portion and left side portion, the housing defining a barrier support frame, the housing comprising a housing bottom panel with a central opening, and a housing top panel with a central opening, the at least one sheet of mesh barrier material being located in the housing while in its first spooled position, the at least one sheet of mesh barrier material being laterally and reversibly extensible from the first spooled position to the second extended position;

a roller pole having an upper portion, a lower portion and an interior lumen;

a threaded rod extending upwardly through the bottom panel central opening into the housing, through the interior lumen of the roller pole, and through the top panel central opening, the threaded rod being secured in place on the top panel by a threaded rod nut;

a barrier stand having a top portion and a bottom portion, the barrier stand top portion extending upwardly through the bottom panel central opening and into a lower portion of the roller pole interior lumen, the roller pole being mounted for axial rotation with respect to the barrier stand, the at least one sheet of mesh barrier material being carried on the roller pole;

a shaping wheel rotatably mounted on the roller pole, the shaping wheel rotating in response to rotation of a gear operably connected to the roller pole, the shaping wheel being constructed and arranged to move the at least one sheet of mesh barrier material as the shaping wheel rotates on the roller pole, a handle shaft operably connected to the gear; and a rotatable handle operably connected to the handle shaft;

whereby in response to rotation of the rotatable handle, the at least one sheet of mesh barrier material may be reversibly extended to the second extended position to provide a temporary barrier.

2. The removable barrier apparatus of claim 1 wherein:

the at least one sheet of mesh barrier material comprises a first mesh barrier portion constructed and arranged for reversible lateral deployment from the right side portion of the housing.

3. The removable barrier apparatus of claim 2 wherein the at least one sheet of mesh barrier material further comprises a second mesh barrier portion constructed for reversible lateral deployment from the left side portion of the housing.

4. The removable barrier apparatus of claim 1 further comprising a front impact cushion mounted to the front portion of the housing.

5. The removable barrier apparatus of claim 1 further comprising a wheeled base member on which the housing is supported and carried.

6. The removable barrier apparatus of claim 5 further comprising:

at least one support leg mounted to and extending downwardly from the base.

7. The removable barrier apparatus of claim 1 further comprising a rear portion, and a retractable extensible tow hitch receiver insert located at the rear portion thereof, the tow hitch receiver insert being constructed and arranged for releasable connection to a vehicle tow hitch.

8. The removable barrier apparatus of claim 7 wherein the tow hitch receiver insert comprises a plurality of telescoping portions retained together by at least one receiving pin, the tow hitch receiver insert being up to about three feet in length.

9. The removable barrier apparatus of claim 1 further comprising a power source selected from solar power, a 12 Volt battery, a vehicle battery and combinations thereof.

10. The removable barrier apparatus of claim 9 further comprising a motor, and wherein reversible deployment of the at least one sheet of mesh barrier is effected remotely.

11. The removable barrier apparatus of claim 9 further comprising at least one solar panel.

12. The removable barrier apparatus of claim 11 wherein the at least one solar panel is located at the housing top panel.

13. The removable barrier apparatus of claim 11 wherein the at least one sheet of barrier material further comprises a plurality of solar panels.

14. The removable barrier apparatus of claim 9 further comprising at least one LED light.

15. The removable barrier apparatus of claim 1 wherein the at least one sheet of barrier material further comprises at least one reflector.

16. The removable barrier apparatus of claim 1 comprising at least one sign removably mounted to the at least one sheet of barrier material.

* * * * *